United States Patent [19]

Ghini

[11] Patent Number: 4,690,282

[45] Date of Patent: Sep. 1, 1987

[54] BLANK FOR PARALLELEPIPED DISPENSING CARTON

[75] Inventor: Mario Ghini, Cassino, Italy

[73] Assignee: IN.GR.ED. Industrie Grafiche Editoriali S.p.A., Latina, Italy

[21] Appl. No.: 804,035

[22] Filed: Dec. 3, 1985

Related U.S. Application Data

[63] Continuation-in-part of Ser. No. 535,955, Sep. 26, 1983, abandoned.

[30] Foreign Application Priority Data

Sep. 28, 1982 [IT] Italy ..... 49177 A/82

[51] Int. Cl.[4] ..... B65D 5/74

[52] U.S. Cl. ..... 206/626; 229/17 R; 229/52 B; 229/137

[58] Field of Search ..... 229/17 R, 17 G, 37 R, 229/52 B, 37 E, 7 R; 206/626, 634, 625

[56] References Cited

U.S. PATENT DOCUMENTS

| | | | |
|---|---|---|---|
| 2,313,987 | 3/1943 | Buttery | 229/17 R |
| 3,189,246 | 6/1965 | Seline, Jr. | 229/17 G |
| 3,346,167 | 10/1967 | Schmidt | 206/626 X |
| 3,762,627 | 10/1973 | Ross, Jr. et al. | 229/52 B |
| 3,797,731 | 3/1974 | Weldon | 229/52 B |
| 3,892,347 | 7/1975 | Egleston | 229/17 R |
| 3,938,731 | 2/1976 | Ross, Jr. et al. | 229/52 B X |
| 4,180,167 | 12/1979 | Leavitt et al. | 206/622 |
| 4,412,619 | 11/1983 | Van Laer | 206/611 |

FOREIGN PATENT DOCUMENTS

| | | | |
|---|---|---|---|
| 0120530 | 10/1984 | European Pat. Off. | 229/52 B |
| 811569 | 7/1949 | Fed. Rep. of Germany . | |
| 1293077 | 4/1969 | Fed. Rep. of Germany . | |
| 2271989 | 12/1975 | France . | |
| 2427259 | 12/1979 | France . | |
| 2446232 | 9/1980 | France | 229/37 R |
| 93254 | 11/1938 | Sweden | 229/37 R |
| 300093 | 4/1968 | Sweden | 229/17 R |

*Primary Examiner*—Stephen Marcus
*Assistant Examiner*—Bryon Gehman
*Attorney, Agent, or Firm*—Beveridge, DeGrandi and Weilacher

[57] ABSTRACT

A blank has four top wall areas which serve as flaps for forming the top of a parallelepiped box. Fold lines connect the top wall areas to each other to reduce the risk of leakage from the box. One of the top wall areas has two oblique fold lines therein or at its edges, and two other top wall areas are formed to permit the formation of a spout for dispensing the contents of the box. These spout-forming top wall areas are provided with oblique folding lines which extend to a corner of the box and are arranged to register with each other in the completed box. Markings and/or a line of weakness identify a severance line which, after being severed, permits movement of portions of the spout forming top wall areas to a vertical position to provide a dispensing spout.

3 Claims, 9 Drawing Figures

BLANK FOR PARALLELEPIPED DISPENSING CARTON

REFERENCE TO RELATED APPLICATION

This is a continuation-in-part of application Ser. No. 535,955 filed Sept. 26, 1983, now abandoned, the entirety of which is incorporated herein by reference.

BACKGROUND OF THE INVENTION

This invention relates to a box and to a blank for forming the box. The blank is formed of a paperboard sheet or like material having folding lines impressed therein, so that when the sheet is appropriately folded on the folding lines it forms a parallelepipedal box for solid or liquid materials.

Boxes formed of semifinished sheets provided with folding lines arranged to form a parallelepiped shaped box, especially for packaging liquids such as milk, fruit juices and the like, are well known in the art. These semifinished sheets have had some inconveniences in that some require long and onerous folding operations, particularly when used for liquids, and in some instances boxes have not always been perfectly sealed, thereby causing problems when they leak and lose all or part of their contents.

An objective of the present invention is to avoid the inconveniences of certain prior art blanks and boxes and to provide improved blanks and improved boxes which have folding and fold lines arranged so that a well-sealed box may easily be formed for containing liquids or powders. The blanks according to the present invention are easily folded to form a box which has an uncomplicated and convenient spout for dispensing its contents. The resulting box is sealed in order to deter the leakage of liquids or powders from the box.

SUMMARY OF THE INVENTION

In one respect, the invention involves a blank which has two longitudinal folding lines and four transverse folding lines which subdivide the sheet into four side wall areas, one marginal sealing area, four top wall areas and four bottom wall areas. First and second top wall areas each have a diagonal folding line therein, and these lines form therebetween a spout means for dispensing the contents of the box These diagonal folding lines form a right angle which opens toward a longitudinal edge of the sheet. A third area of the top wall has two fold lines which extend only partially thereacross and intersect two cut lines which extend from a longitudinal edge of the sheet. A fourth area of the top wall has a diagonal folding line which extends in the direction which is opposed to the direction of a diagonal folding line formed in the second top wall area. According to this aspect of the invention, the four bottom wall areas have folding lines which are identical to those of the top wall except that the third area of the bottom wall has no folding lines and the first area of the bottom wall has two fold lines and two cut lines corresponding to those of the third area of the top wall. In one particular embodiment of this invention, the sheet is arranged to form a liquid tight box by the utilization of extension areas which extend transversely from the areas of the top and bottom walls and are adapted to be folded over the respective top and bottom walls in the completed box to provide a liquid tight closure. In another form, a handle is formed by a handle portion in a third area of the top wall and a handle portion which extends transversely from the first area of the top wall. These handle portions have corresponding shapes and they are provided with apertures which align with each other to provide a hand hole when the box is set up. The third area of the top wall includes a tear strip which is tearable to release the handle portions to permit them to be raised to an upright carrying position. In one embodiment of the invention, the oblique fold lines may form the edges of the third top wall area, and this third top wall area is transversely narrower than the other top wall areas so that it may be folded outwardly and sealed to another top wall area to form a narrow outwardly protruding flange when the box is erected. The cut-indicating means may constitute lines of weaknesses formed in the first and second top wall areas, these lines of weakness being adapted to overlie each other when the box is set up. These lines of weaknesses can be shaped to provide, in the box, an opening and two interconnected triangular areas which are transversely spaced from the opening to form the spout.

In another respect, the invention involves a semifinished sheet, i.e. a blank, for making parallelepiped boxes, wherein a third top wall area has oblique fold lines extending from the points where longitudinal fold lines intersect two transverse fold lines. Second and fourth top wall areas are disposed on opposite sides of the third top wall area and are connected thereto by transverse fold lines. The second and fourth top wall areas each have an oblique fold line which is substantially parallel to the oblique fold line which is nearest thereto on the third top wall area. A first top wall area also has an oblique fold line, and this fold line intersects the oblique fold line of the second top wall area at a location where a longitudinal fold line intersects the transverse fold line which connects the first top wall area to the second top wall area. Due to this arrangement, when the sheet is erected into a box, the fold line in the first top wall area will register with the fold line in the second top wall area. Cut indicating means are provided in the top wall to facilitate the formation of a dispensing spout. A cut made according to the cut indicating means extends between the registered fold lines in the first and second top wall areas to form a spout in the box.

The invention also involves the box which has the advantages of the invention. This box has bottom flaps which are connected to the side walls to form a box bottom, and top flaps which are connected to the side walls by fold lines to form a box top which is perpendicular to the side walls of the box. At one corner of the box, there is a spout-forming structure which includes first and second top flaps which are connected to each other by a flap-connecting fold line. One of these latter flaps is folded upon itself along an oblique fold line which extends to the corner of the box and is disposed obliquely in the box top. Means are provided for guiding the severing of the box top along a severance line which extends from the flap-connecting fold line to the oblique fold line. The top flaps have spout-forming portions between the severance line and the corner of the box. After the box top has been severed along the severance line, the spout forming portions are foldable upwardly to a vertical position to provide a dispensing spout. Preferably of the two spout-forming top flaps, one of these is not folded upon itself and is provided with an oblique folding line impressed therein in register with the oblique fold line of the other spout-forming flap. Also, each of the top flaps is preferably connected by fold lines to both of its adjacent top flaps. A third top flap may have two oblique fold lines extending partially thereacross and two cut lines which extend from the oblique fold lines to an edge of the third top flap. The box may have a narrow top flap which is folded outwardly to form a narrow protruding flange. A perforated line may be used to guide the severing of the box, thereby forming a line of weakness which may be shaped to provide an opening and two interconnected triangular areas which are transversely spaced from the opening to form a spout.

BRIEF DESCRIPTION OF THE DRAWINGS

The present invention will be now described as an example with reference to some embodiments illustrated in the drawings in which.

DETAILED DESCRIPTION

Figure 1:
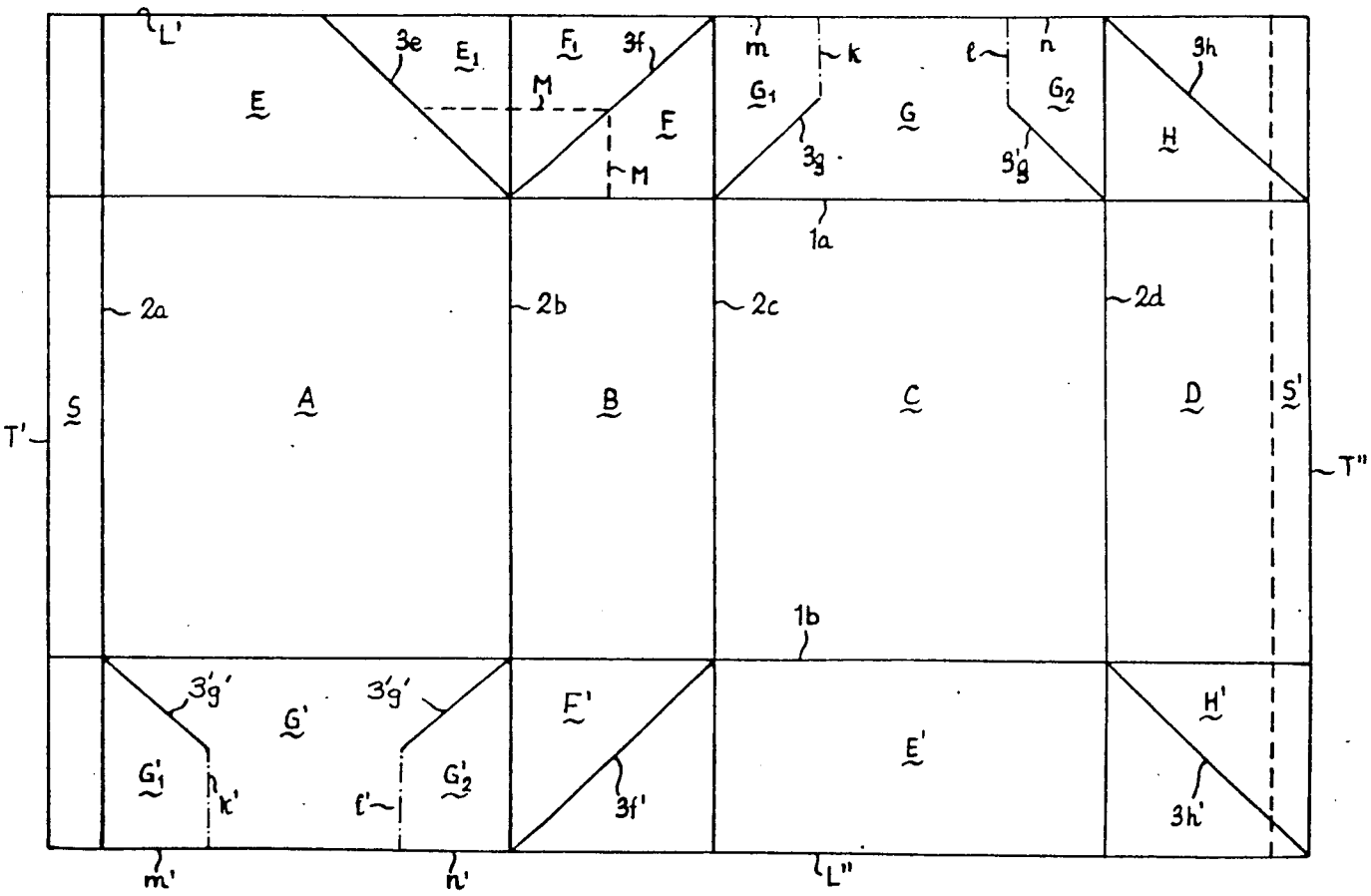
FIG. 1 represents a plan view of a first embodiment of the blank provided with folding lines.

As it may be noted in FIG. 1, the semifinished sheet is provided, in a conventional way, with two longitudinal folding lines 1*a* and 1*b* and four transverse folding lines 2*a*, 2*b*, 2*c* and 2*d* which define therebetween along with one transverse edge T'', the four side walls A, B, C and D of the box. The first transverse folding line 2*a* and the other transverse edge T' of the sheet define a narrow margin area S represented by hatching, suited to be sealed under a corresponding area S' which lies adjacent to the transverse edge T'.

The section included between the longitudinal folding line 1*a* and the longitudinal edge L' of the sheet forms the top wall of the box. This top section is subdivided by the four transverse folding lines A, B, C and D into four areas E, F, G and H.

The area E is provided with an oblique folding line 3*e* extending at a 45° angle with respect to the longitudinal edge $L_1$ to form, in the area E, a right-angled triangle section E'. The square area has a diagonal folding line 3*f* perpendicular to the folding line 3*e*, which forms a right-angled triangular area F', both the areas E' and F' being suited to constitute the spout dispenser of the contents of the box after the same has been opened.

The rectangular area G has a first oblique folding line 3*g*, parallel to the folding line 3*f* and a second folding line 3'*g* perpendicular to the first one. These two folding lines are impressed on the sheet up to the half of the longest extension, and they terminate at two cut lines l, k which are disposed perpendicular to the longitudinal edge L of the sheet to differentiate the cut lines k and l from the fold lines of the sheet, the cut lines are illustrated as dot-dash lines.

Finally, the area H has a diagonal folding line 3*h* which is parallel to the folding line 3'*g*.

The bottom section consists of four areas, E', F', G' and H' which are identical to the areas E, F, G and H of the top wall, except that the area E' does not have the oblique folding line 3*e*, because obviously the bottom of the box does not need a dispenser of the contents.

A box formed of the disclosed blank is particularly suited to contain powder materials such as salt, sugar, flour and the like, because the top wall and the bottom wall provide an effective seal to avoid the discharge of the contents of the box.

Figure 2:
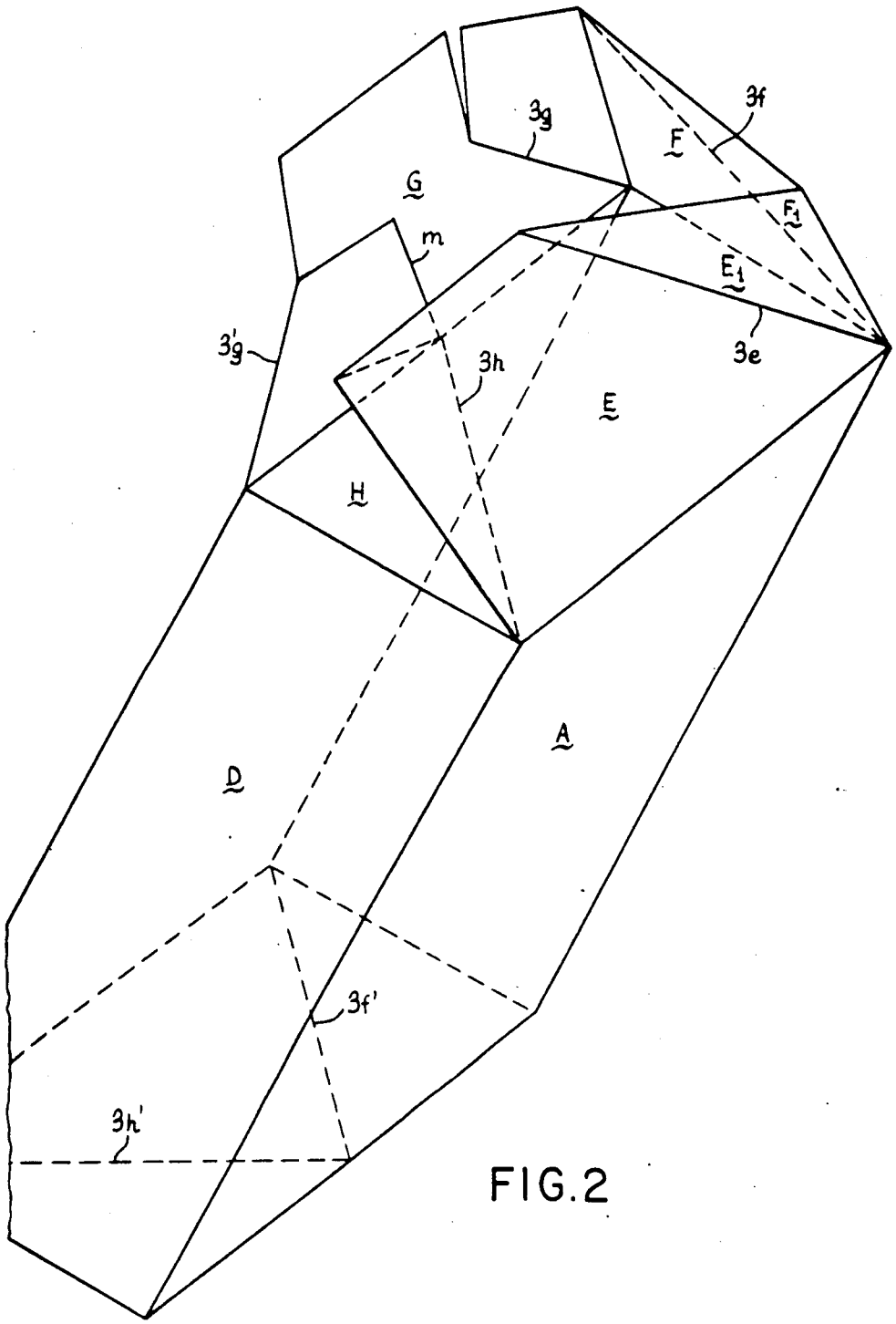
FIG. 2 is a schematic perspective view of the box manufactured by using the blank of FIG. 1.

FIG. 2 represents a perspective view of the erection of a box made with the blank of FIG. 1. To form the box, the sheet is initially folded on the transverse folding lines and the margin area S is sealed under the corresponding part of the area D to form a parallelepipedal box, having the bottom and top walls still open. Then the bottom is closed by folding the area E' along the corresponding segment of the longitudinal folding line 1*b*, whereby the areas F' and H' are folded around the folding lines 3*f'* and 3*h'*, respectively, so that each of them forms a double layer triangular area. As a consequence, the inner side of the area E' is abutted to the inner triangular side of areas F' and H'. Subsequently areas $G'_1$ and $G'_2$ are folded around folding lines $3'_{g'}$, and 3*g'* under area G' so that the edges m' and n' match each other. Tab G' is then sealed to area E'. As can easily be understood, this closure mode seals the bottom of the box, so that it is suitable for containing very fine powders.

The upper wall is closed in a similar way. However, in the top, the area E has the folding line 3*e* which forms in cooperation with the folding line 3*f* a spout for dispensing the contents of the box. The eventual user forms the spout cutting along line M with a knife or scissors. The line M is shown in FIG. 1.

In FIG. 2, the area H is already slightly folded on folding line 3*h*, while area F has not been folded yet in order to show the dispenser spout E' and F'. Area G' is already almost completely folded under area G on the folding line 3'*g*, while area $G_2$ is still to be folded around folding line 3*g* in order to let the edge m match with the edge n under area G.

Figure 3:
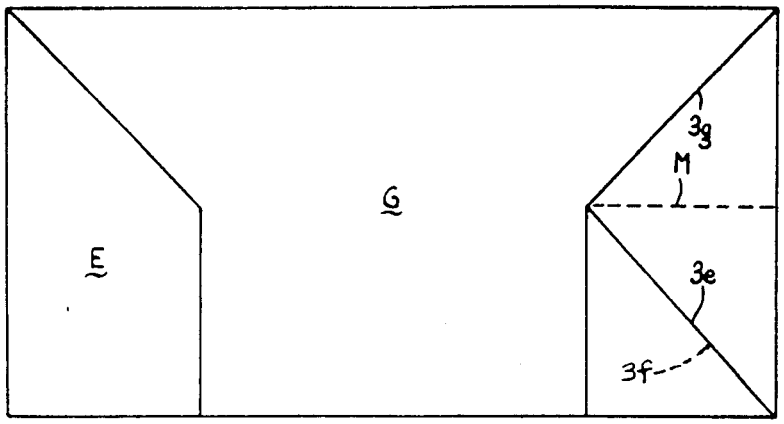
FIG. 3 is a plan view of the top wall of the box according to FIG. 2, when the box is closed.

FIG. 3 shows an embodiment of the semi-finished sheet piece, particularly suitable for the manufacture of boxes for containing liquids. As shown, the sheet has folding lines quite similar to the folding lines shown in FIG. 1. Additionally, in order to provide a box which is sealed more tightly, the blank of FIG. 3 has two zones Z and Z' which are extensions of areas E, F and H and E', F' and H', respectively.

Figure 5:
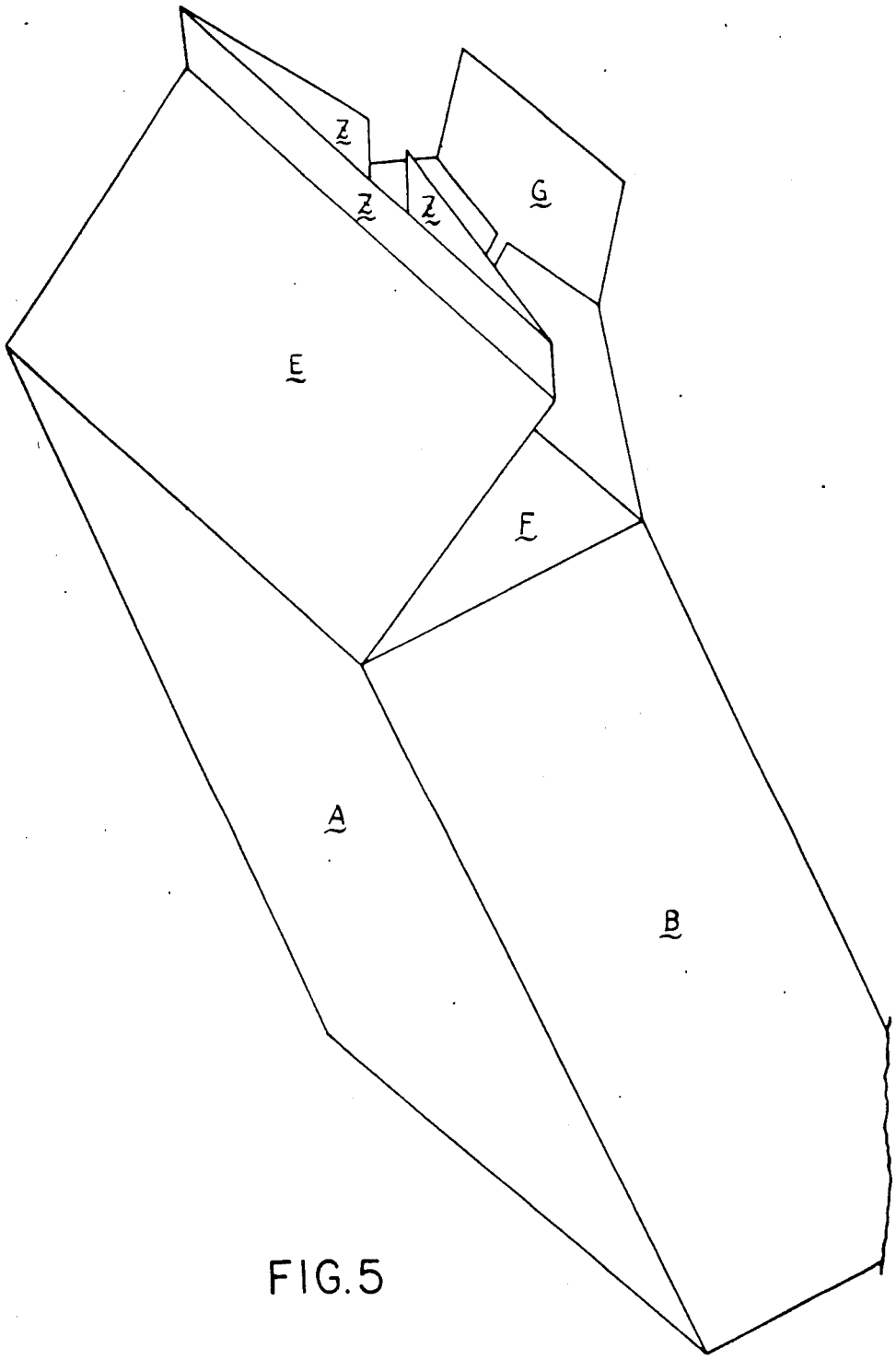
FIG. 5 is a perspective view of the box manufactured by using the blank of FIG. 4.

When forming a box from the blank of FIG. 3, after sealing zone S under the corresponding zone of area D, the upper wall and the bottom, respectively are closed. This brings the zones Z and Z' extending from areas F, H and F', H' under the zones Z and Z' which extend from areas E and E'. The zones Z and Z' are then folded in the direction shown in FIG. 5. Next, the areas G and G' are folded to their final positions, thereby tightly closing the upper wall and the bottom of the box. The arrangement of zone Z of the upper wall is schematically shown in perspective view in FIG. 5 where it will be seen that, when areas F and H are folded around the oblique folding lines 3*f* and 3*h*, the zones Z extending from areas F and H come to lie under the zone Z which extends from area E, and the zones Z are then together backwardly folded with closing area G.

Figure 6:
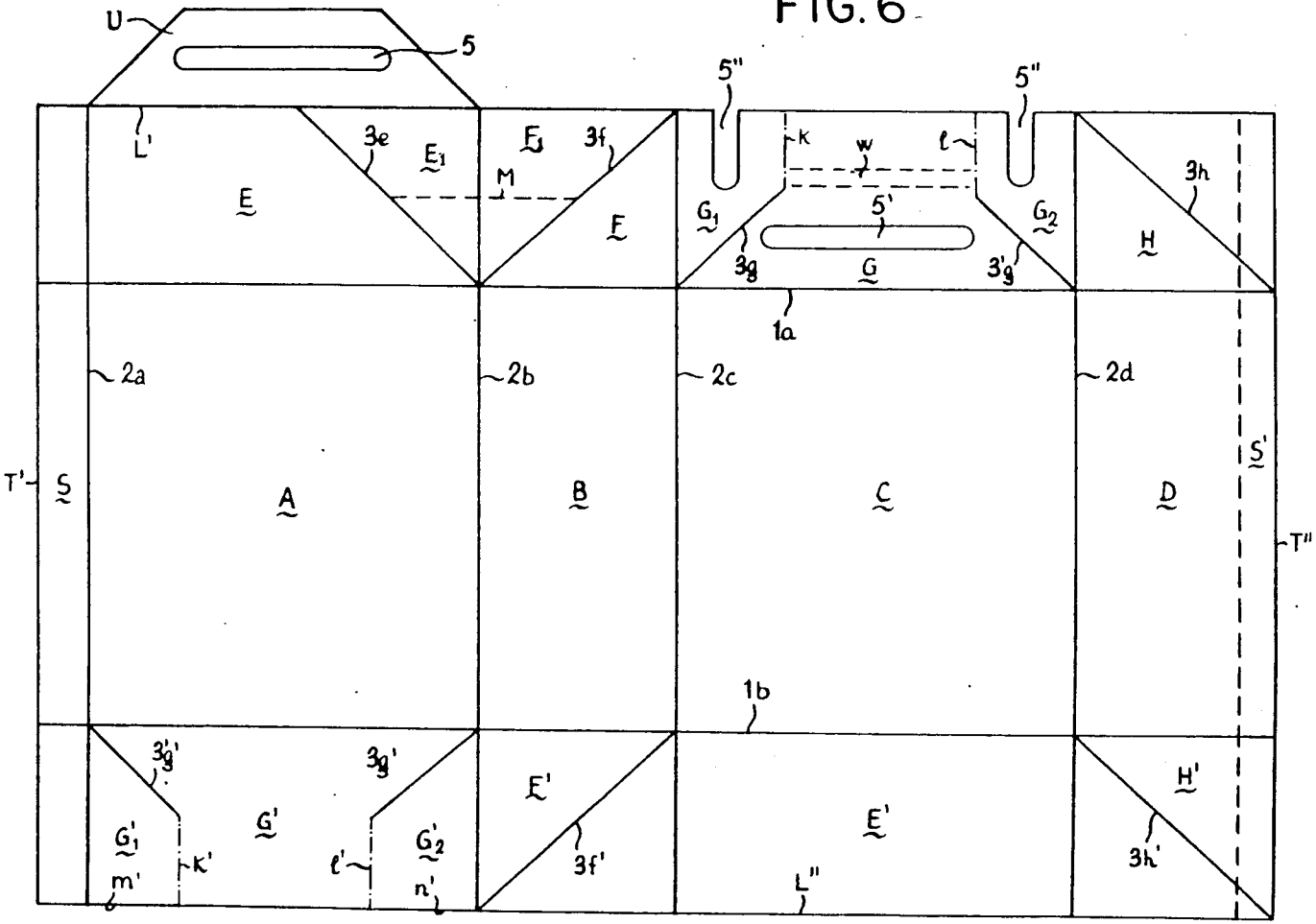
FIG. 6 represents a third embodiment of the blank.

A third embodiment of the semi-finished blank according to this invention is shown in FIG. 6, which is particularly suitable for manufacture of larger boxes such as those intended for pulverulent materials such as detergents.

As it can be seen in FIG. 6, this embodiment is different from the embodiment of FIG. 1 in that a handle portion U extends from area E. Hand hole notches 5 and 5' are provided in portion U and area G to facilitate carrying of the box. This type of box has an inner jacket which corresponds in shape to areas A, B, C, D and G. The inner jacket is inserted in the box after the zone S is sealed and after the bottom of the box is closed. In the portion corresponding to area G' the jacket has a notch identical to notch 5'. Therefore, the jacket is closed by area G on one side and by areas $G_1$ and $G_2$, on the other side, having half-notches 5'' which, after having been folded around the oblique folding lines 3*g* and 3'*g* match with the notches of area G and of the inner jacket.

Figure 7:
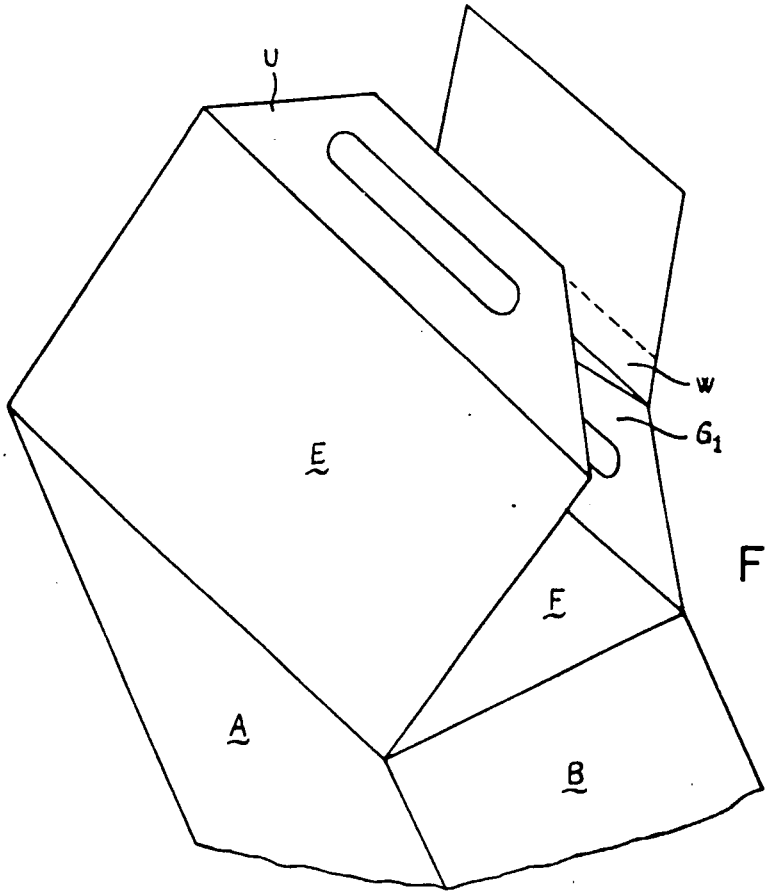
FIG. 7 represents a perspective view of a box manufactured by using the blank of FIG. 6.
Figure 4:
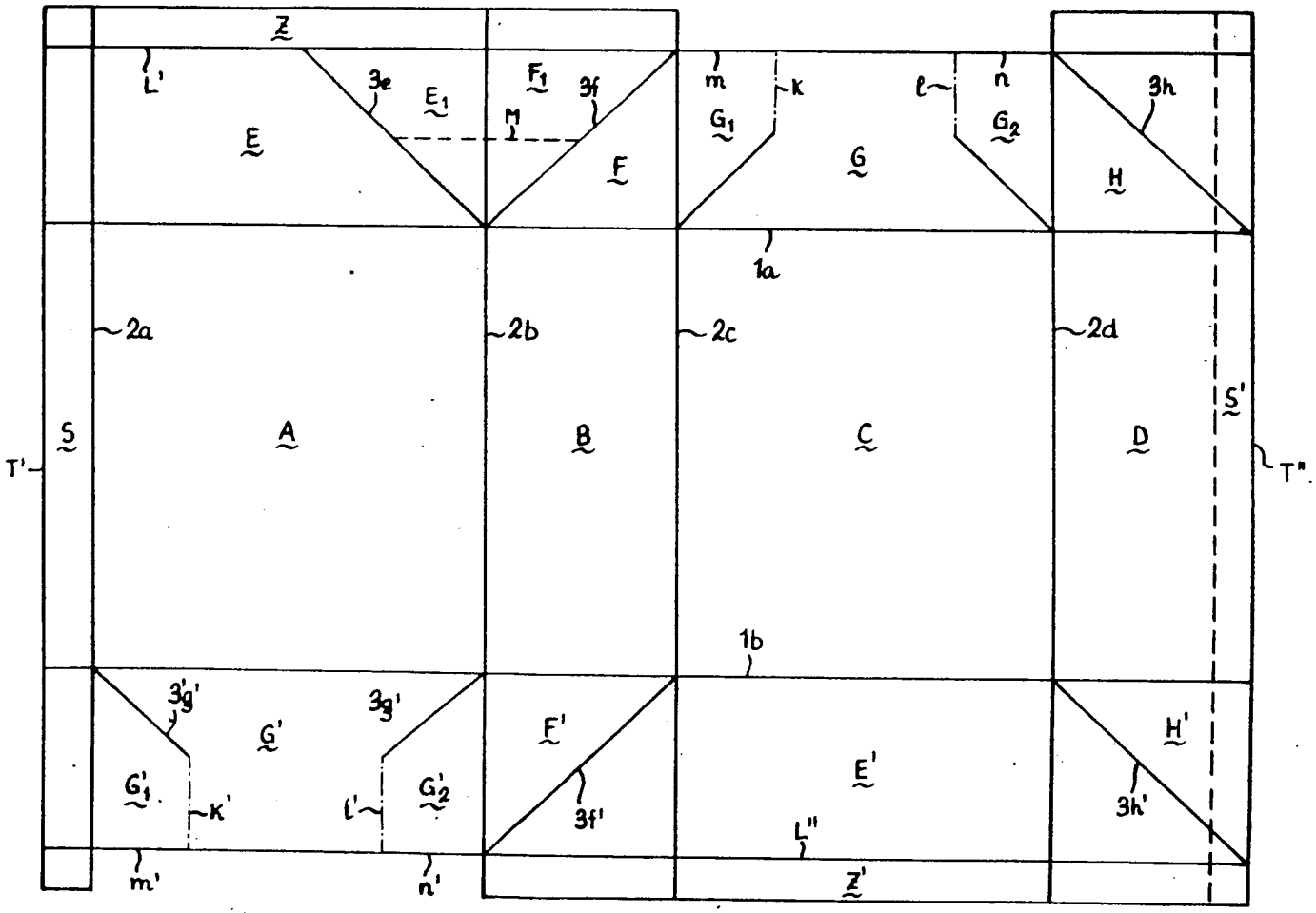
FIG. 4 represents a plan view of a second embodiment of the blank provided with folding lines according to the invention.

The area G is provided with a tear strip w, which can be torn to permit the lifting of the handle U. A dispensing spout may be formed by cutting along the line M, in the similar way as in the box of FIG. 1. A perspective view of the box manufactured with the semifinished sheet of FIG. 6 is shown in FIG. 7. This embodiment of the box offers all the advantages of the FIG. 1 box and due to the inner reinforcement jacket, it makes it practical to manufacture large boxes which may be easily hand transported with the aid of the handle U built in the box itself.

Figure 8:
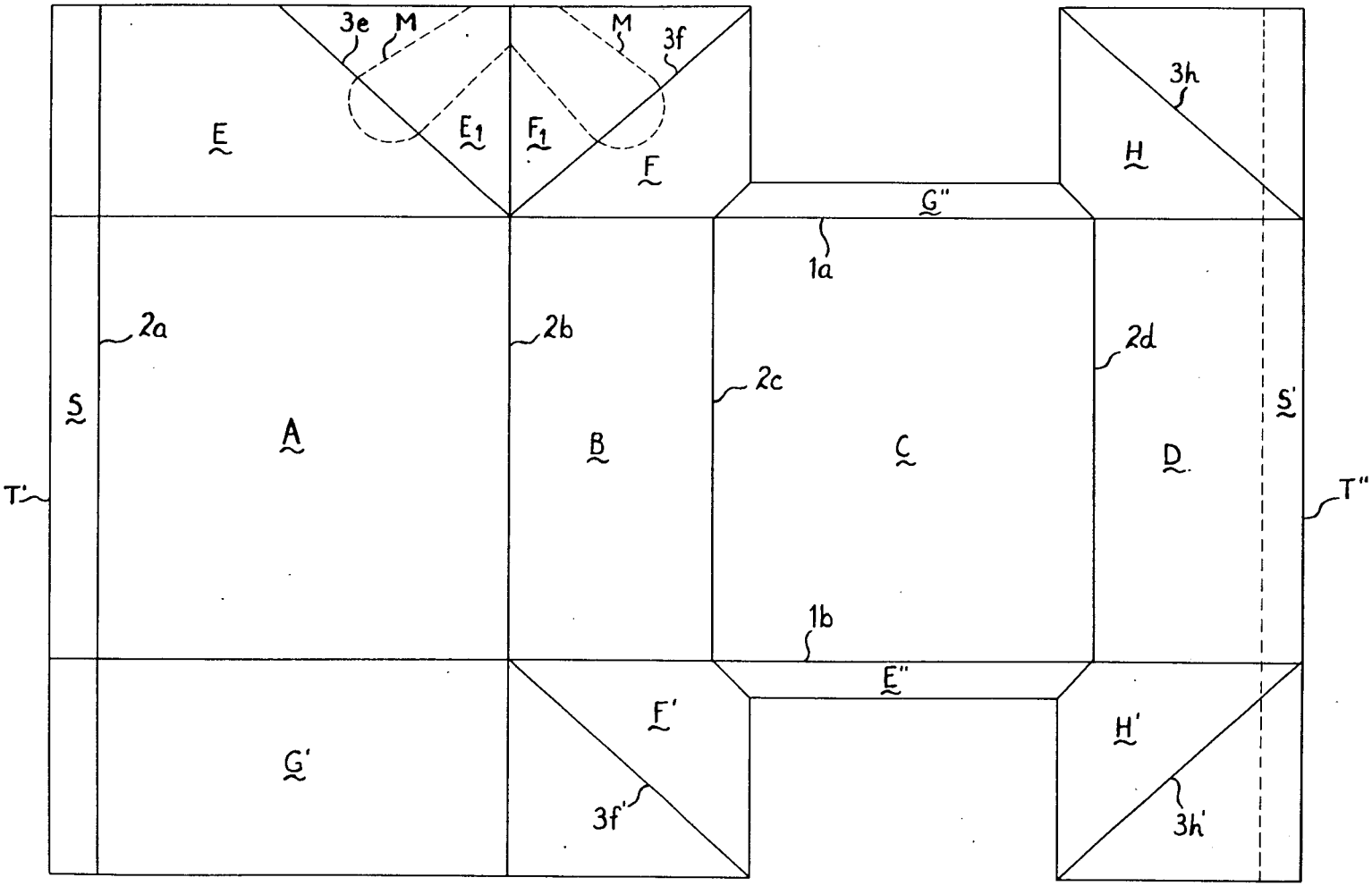
FIG. 8 is a plan view of a blank used in a fourth embodiment of the invention.

FIG. 8 shows a fourth embodiment of a blank intended for forming a box having a narrow top panel G'' which has its upper surface sealed to the overlying portions of panels F and H to form, in the completed box, a sealed upper rim which projects outwardly a short extent from the greater vertical box face C. A similar lower sealed rim E'' extends parallel to the upper rim from the bottom of the box. In the areas E and F of the blank there are two perforated or printed spout lines M, which align with each other in the erected position of the box so that the line M in area E overlies and registers with the line M in area F. After the areas surrounded by lines M are removed by tearing or cutting, the areas $E_1$ and $F_1$ may be easily raised together to a vertical position and spread apart to form a spout.

Figure 9:
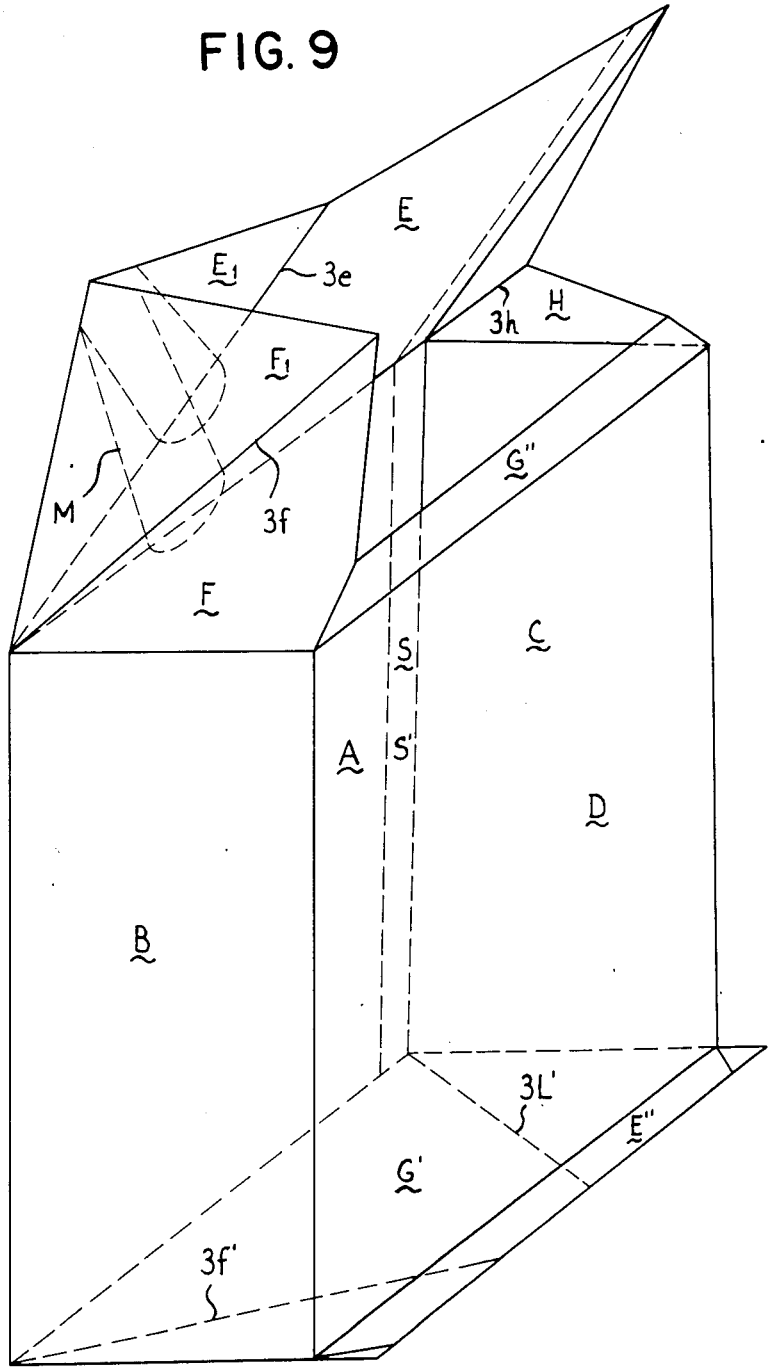
FIG. 9 is a perspective view of the formation of a box using the blank of FIG. 8.

The erection of the box may be clearly seen in FIG. 9. The bottom is formed substantially by the areas G', to which are sealed the upper surfaces of the areas F' and H'. The side edges of areas F' and H' are sealed to the area E''. The upper wall of the box is similarly closed, except that the downwardly facing spout-forming area $F_1$ is not sealed to the area of F therebeneath. This permits the raising of F, as the areas $E_1$ and $F_1$ to their vertical position for forming said spout. This box is particularly suitable for pulverulent materials such as sugar, salt, flour and like, which may be periodically consumed and preserved in the same box.

As will be seen from the foregoing, and as best visualized in FIGS. 2, 5, 7 and 9, a box formed according to the invention has, at the corner where folding lines 1*a* and 2*b* intersect, a spout forming structure provided by the flaps E and F. Flap F is folded upon itself along the folding line 3*f* which is obliquely disposed in the semi-finished blank and in the completed box. The flap E is not folded upon itself, but it has an oblique folding line 3*e* impressed therein where it registers with oblique fold line 3*f* in the completed box. Printed or perforated lines M are provided to guide the severing of the flaps from the flap-connecting fold line 2*f* to the oblique fold line 3*f*. After the box top has been severed along the line M, spout-forming portions of the flaps E and F are liberated so that they can be folded upwardly to a vertical position and then spread apart to provide a dispensing spout for the box. In the embodiment of FIGS. 8 and 9, the perforated tear line M is a line of weakness which also forms, in the box top, a circular opening which is transversely spaced from the two interconnected triangular spout forming areas.

The present invention has been disclosed with reference to some embodiments thereof, but it is understood that several modifications and variations and changes might be made thereon without departing from its scope.

I claim:

1. A rectangular semifinished sheet for manufacturing parallelepiped boxes for solid and fluid substances, having an upper and a lower longitudinal folding line and first, second, third and fourth transverse folding lines which, respectively, subdivide the sheet into a marginal transverse sealing zone, first, second, third and fourth side wall areas and first, second, third and fourth top and bottom wall areas, wherein:

said second top wall area has a quadrate shape and a diagonal folding line starting from the intersection point of said upper longitudinal folding line with said second transverse folding line between said first and second top wall areas and ending at the intersection point of the upper sheet edge with said third transverse folding line between said second and third top wall areas;

said first top wall area has a rectangular shape and an oblique folding line forming a right angle with said diagonal folding line; a first line of weakness extending from said oblique folding line to said diagonal folding line at an intermediate position between said upper sheet edge and said upper longitudinal folding line and parallel thereto and a second line of weakness extending from the intersection point of said first line of weakness with said diagonal folding line to said upper longitudinal folding line perpendicularly thereto;

said third top wall area having a first oblique partial folding line extending parallel to said diagonal folding line from the intersection point of said upper longitudinal folding line with said third transverse folding line, a second oblique folding line symmetrical to said first oblique folding line and first and second cut lines starting parallel to one another from the upper edge of the sheet and ending at the intersection point with said first and second oblique folding lines, respectively;

said first bottom wall area having folding and cut lines identical to those of said third top wall area, said second and fourth bottom wall areas having diagonal folding lines identical to those of said second and fourth top wall areas, no folding lines being provided on said third bottom wall area.

2. A semifinished rectangular sheet as claimed in claim 1, wherein said marginal sealing area, said first, second and fourth top wall areas and said second, third and fourth bottom wall areas are transversely extended to form flange areas which are foldable inwardly over the respective top and bottom wall areas beneath said third top wall area and said first bottom wall area, respectively, whereby a liquid tight closure of the box is obtained.

3. A sheet as claimed in claim 1, wherein on said third top wall area, in a zone between the two symmetrical oblique folding lines, cut lines form a central oblong aperture extending parallel to said upper longitudinal folding line; and, in each area between said cut lines and said transverse folding lines, separating said third top wall area from said second and fourth top wall areas, cut lines forming a central half-aperture extending parallel to said cut lines from the upper sheet edge, said sheet having moreover a fifth top wall area extending from said first top wall area, said fifth top wall area having the shape of said zone between said oblique partial folding lines and an aperture similar to said oblong aperture, a tear strip provided on said third top wall area, said sheet being erectable into a box wherein said two half-apertures are overlapped by said central apertures in said third and fifth areas and said fifth area is releasably secured by said tear strip on the top wall of the box.

* * * * *